US006068420A

United States Patent [19]

Austin et al.

[11] Patent Number: 6,068,420

[45] Date of Patent: May 30, 2000

[54] PRINTER WITH AN INTEGRALLY FORMED SPRING FOR BIASING THE PRINTHEAD

[75] Inventors: Pixie Ann Austin, Marysville; Christopher A. Wiklof, Everett; Cathy L. Aragon, Snohomish, all of Wash.

[73] Assignee: Intermec IP Corporation, Beverly Hills, Calif.

[21] Appl. No.: 09/038,779

[22] Filed: Mar. 11, 1998

Related U.S. Application Data

[63] Continuation-in-part of application No. 08/454,503, May 30, 1995, Pat. No. 5,751,330.

[51] Int. Cl.[7] ..... B41J 29/02; B41J 11/08

[52] U.S. Cl. ..... 400/693; 400/690.1; 400/656

[58] Field of Search ..... 400/693, 690.1, 400/654, 656, 662; 347/108, 107, 222

[56] References Cited

U.S. PATENT DOCUMENTS

| | | | |
|---|---|---|---|
| 3,713,168 | 1/1973 | Baker | 347/170 |
| 3,767,020 | 10/1973 | Rowe . | |
| 4,372,695 | 2/1983 | Ross | 400/119 |
| 4,427,314 | 1/1984 | Fujiwara et al. | 400/338.2 |
| 4,433,925 | 2/1984 | Fujiwara et al. | 400/88 |
| 4,523,235 | 6/1985 | Rajchman | 358/256 |
| 4,547,780 | 10/1985 | Cummins | 346/9 |
| 4,614,949 | 9/1986 | Hakkaku et al. | 400/356 |
| 4,639,739 | 1/1987 | Tsutsumi | 400/593 |
| 4,641,980 | 2/1987 | Matusmoto et al. | 400/693 |
| 4,699,052 | 10/1987 | Lemelson | 101/110 |
| 4,750,049 | 6/1988 | Murakami et al. | 358/296 |
| 4,819,083 | 4/1989 | Kawai et al. | 358/294 |
| 4,851,896 | 7/1989 | Muranaga et al. | 358/443 |
| 4,851,921 | 7/1989 | Sato et al. | 358/473 |
| 4,862,281 | 8/1989 | Sato et al. | 358/400 |
| 4,868,676 | 9/1989 | Matsumura et al. | 347/222 |
| 4,887,165 | 12/1989 | Sato et al. | 358/474 |

(List continued on next page.)

FOREIGN PATENT DOCUMENTS

| | | |
|---|---|---|
| 61-035-391 | 2/1986 | Japan . |
| 63-290-780 | 11/1988 | Japan . |
| 4-296569 | 10/1992 | Japan . |

OTHER PUBLICATIONS

"Axiohm A793 Clamshell™ Thermal Receipt Printer," Axiohm, Inc. Website: www.axiohm.com, Copyright 1997, 2 pp.

"Eltron LP2442," *Eltron International, Inc. Preliminary Article,* Dec. 17, 1997, 3 pp.

"Eltron Bar Code & Label Printers," *McBride Computer Services,* Website: http://www.dmcbride.com/eltron.htm, Dec. 16, 1997, pp. 1–3.

(List continued on next page.)

*Primary Examiner*—Ren Yan
*Assistant Examiner*—Daniel J. Colilla
*Attorney, Agent, or Firm*—Perkins Coie LLP

[57] ABSTRACT

A clamshell printer having a base and a cover pivotally mounted to the base for movement between an open and a closed position, wherein the open position provides unhindered access to a media path and a print head in the printer. The printer may include a platen formed integrally therein or a platen rollingly supported in the printer. A media supply, such as a continuous sheet of linerless thermal media in the form of a roll may be quickly and efficiently drop-loaded into the printer, with no threading of the media required. Unhindered access to the print head is also provided. The printer may or may not include a drive mechanism for advancing the media through the printer. The print head is controlled by a microprocessor mounted to a circuit board in the printer. The circuit board may be spring-biased to urge the print head toward a printing position, which is located at an effective printing distance from the media and the platen. A window may be formed in the printer for observing the media supply.

40 Claims, 4 Drawing Sheets

U.S. PATENT DOCUMENTS

| | | | |
|---|---|---|---|
| 4,894,730 | 1/1990 | Yanagawa et al. | 358/473 |
| 4,899,228 | 2/1990 | Sano et al. | 358/473 |
| 4,903,232 | 2/1990 | O'Connell et al. | 364/900 |
| 4,915,027 | 4/1990 | Ishibashi et al. | 101/486 |
| 4,928,183 | 5/1990 | Yajima | 358/296 |
| 4,947,262 | 8/1990 | Yajima et al. | 364/519 |
| 4,949,283 | 8/1990 | Yamauchi et al. | 364/519 |
| 4,999,016 | 3/1991 | Suzuki et al. | 400/88 |
| 5,020,928 | 6/1991 | Akiyama et al. | 400/193 |
| 5,024,541 | 6/1991 | Tsukada et al. | 400/88 |
| 5,052,832 | 10/1991 | Akiyama et al. | 400/120 |
| 5,079,639 | 1/1992 | Mochinaga | 358/473 |
| 5,112,149 | 5/1992 | Suenaga | 400/88 |
| 5,131,090 | 7/1992 | Fukushima | 395/700 |
| 5,150,130 | 9/1992 | Sato | 101/288 |
| 5,240,334 | 8/1993 | Epstein et al. | 400/88 |
| 5,366,302 | 11/1994 | Masumura et al. | 400/120.16 |
| 5,694,159 | 12/1997 | Kajiya | 347/197 |
| 5,751,330 | 5/1998 | Austin et al. | 347/171 |

OTHER PUBLICATIONS

"Low Cost Direct Thermal and Thermal Transfer Label Printers," *Eltron International, Inc.,* Website: http://www, eltron.com, 2 pp.

"Eltron TLP–2242 Thermal Transfer,"*Raco Industries,* Website: http;//www.racoindustries.com/tlp2242.htm, Dec. 16, 1997, pp. 1–2.

Slattery, Dennis. "Eltron® Bar Code Label Printers and More . . .," *Eltron International, Inc.,* Website: http://www.eltron.com/new1.htm, pp. 1–2.

"What's New at *Eltron International, Inc.*"Website: http://www.eltron.com/new1.htm, pp. 1–2.

"The New Eltron Companion™ Series," *Eltron International, Inc.,* Website: http://www.eltron.com/eltron, 2 pp.

"Eltron Companion+Direct Thermal Label Printers Features/Pricing/Photo," *Raco Industries,* Website: http://www.racoindustries.com/comppf.htm, Dec. 16, 1997, pp. 1–2.

PRINTER WITH AN INTEGRALLY FORMED SPRING FOR BIASING THE PRINTHEAD

CROSS-REFERENCE TO RELATED APPLICATION

This application is a continuation-in-part of U.S. patent application Ser. No. 08/454,503, filed May 30, 1995, now U.S. Pat. No. 5,751,330.

TECHNICAL FIELD

The present invention relates to printers, such as printers used for printing bar code symbols and other images.

BACKGROUND OF THE INVENTION

Typically, printers require a supply of a print media, such as paper, to be loaded into the printer and controllably moved through the printer along a media path. The media is often supplied as either a continuous stream of paper or as individual sheets. The paper is usually fed into the printer using either a tractor-feed mechanism or a friction-feed mechanism. With reference to FIG. 1, the tractor-feed technique employs a continuous length of paper with holes evenly perforated along both sides. The paper is threaded into the paper transport mechanism, and inserted onto sprocket wheels 1 located just over the platen 2. The teeth on each sprocket wheel 1 mesh exactly with holes in the paper. The platen 2 and sprocket wheels 1 are mechanically linked, such that as the platen is advanced, the sprocket wheels 1 turn to pull paper through evenly. Some tractor-fed configurations can be threaded so that the paper is pushed through the printer instead of being pulled through. Pressure or contact rollers 8 are provided to hold the paper firmly against the platen 2 to ensure positive traction and even paper advance. Bail rollers 3 may also be provided to hold paper flat while the paper travels around the platen and along the paper path. The platen 2 is not only used to advance the paper but is also used to provide a support surface for the paper aligned with a print head 4. A feed guide 6 may also be provided for directing the paper 7 along the media path.

With reference to FIG. 2, a friction-feed paper transport system will work with a variety of media types, such as a continuous sheet of paper 7 wound in a roll, or a stack of individual sheets of paper (not shown). A mechanical lever (not shown) is often used to pry pressure rollers 8 away from the platen 2 while paper 10 is being threaded and aligned. When the lever is released, pressure rollers 8 are brought into tight contact with the paper 7 and the platen 2. As the platen advances, contact forces between the platen 2 and the pressure rollers 8 advance the paper along the media path. Bail rollers 3 are provided to keep paper flat and even against the platen 14 as paper leaves the printer.

The drive rollers or platen 2 often are driven by a stepper motor that drives the drive rollers in small increments or steps such that the paper 7 is propelled incrementally or stepped through the printer, pausing slightly between each step. As the paper is stepped through the printer it passes a conventional print head having a linear array of elements, such as a thermal print head or an ink jet print head. During each pause between steps, a small portion of the paper is aligned with the print head and selected elements of the print head are activated to produce a portion of an image on the portion of the paper aligned with the print head.

This image portion is a small portion of an entire image to be printed. The entire image typically is produced by stepping the paper past the print head, pausing the paper after each step, determining a step number (e.g., fifth step or sixth step) corresponding to the pause, determining the portion of the image corresponding to the step number, determining which elements of the print head to activate to produce the determined portion of the image, and activating the determined elements to produce the determined portion of the image on the paper. A microprocessor controls such operation.

Loading paper in a tractor-fed mechanism is often a difficult task. Typically, the paper must be threaded through a slot formed in the housing of the printer, and engaged with the sprocket wheels. A pair of spring-loaded guides are typically pivoted away from the sprocket wheels allowing the perforations in the paper to be placed over the sprockets of the wheels. The paper must be carefully aligned such that the sprockets engage corresponding perforations on each side of the paper. Only after the paper has been properly aligned may the guides be pivoted back into place. The guides prevent the paper from jumping off the sprockets. Access to the print head is extremely limited since the print head is often positioned in close proximity to the platen.

Similar difficulties are encountered with friction-feed mechanisms. While a friction-feed system will usually automatically thread the paper through the feed mechanism, it is often difficult to remove paper which becomes jammed in the media path. This is due to the substantially fixed distance between the print head and the platen. Access to the print head is usually limited, making repairs difficult.

Depending upon the type of print head, the print head is positioned either adjacent or proximate the media. For example, a thermal print head must be sufficiently close to the print medium to permit the heat produced by the resistive elements of the print head to warm the thermally sensitive print media or print ribbon. In another example, impact printers must actually make physical contact with the print medium or a ribbon between the print medium and the print head to form printed letters. Alternatively, an ink jet print head must be spaced sufficiently from the media to allow precise dots to be formed.

SUMMARY OF THE INVENTION

The present invention overcomes the limitations of the prior art by providing a clam-shell shaped printer which includes a base and a cover pivotally coupled to the base for movement between an open and a closed position. A platen may be received in the housing for supporting media, such as paper, as the media is advanced along a media path defined through the housing. A print head is received in the housing and coupled thereto such that the print head is positioned in a printing position, proximate or adjacent the platen, when the cover is in the closed position. Moving the cover to the open position moves the print head away from the printing position, providing unimpeded access to the media path and the print head.

The print head may be coupled to a microprocessor carried in the printer, and may be biased by a spring toward the printing position. The print head and the microprocessor may be mounted on a printed circuit board which may itself be spring-biased toward the printing position. The spring may be integrally formed with the housing.

A drive mechanism, such as a stepper motor and appropriate gears may be provided for advancing the media through the housing. The microprocessor may control the stepper motor, permitting the print head and drive mechanism to be synchronized. Alternatively, or in addition thereto, the printer may employ various devices for determining the position of the media relative to the print head. An internal power source, such as a battery, may power the microprocessor and the drive mechanism.

The printer may be designed to work with any type of media. In one embodiment, the media takes the form of a roll of thermally sensitive, linerless print media that is received in a media receptacle defined in the printer. The roll of print media may be wound on a roll axle that is supported by a pair of bearing surfaces defined in the printer. A window may be provided in the printer for determining the amount of media remaining. A tear bar may be provided at an exit of the printer for permitting a continuous sheet of the media to be torn.

DETAILED DESCRIPTION OF THE INVENTION

In the following description, certain specific details are set forth in order to provide a thorough understanding of various embodiments of the present invention. However, one skilled in the art will understand that the present invention may be practiced without these details. In other instances, well-known structures associated with printers, drive mechanisms, print heads, and print media have not been shown in detail in order to avoid unnecessarily obscuring the description of the embodiments of the invention.

Figure 1:
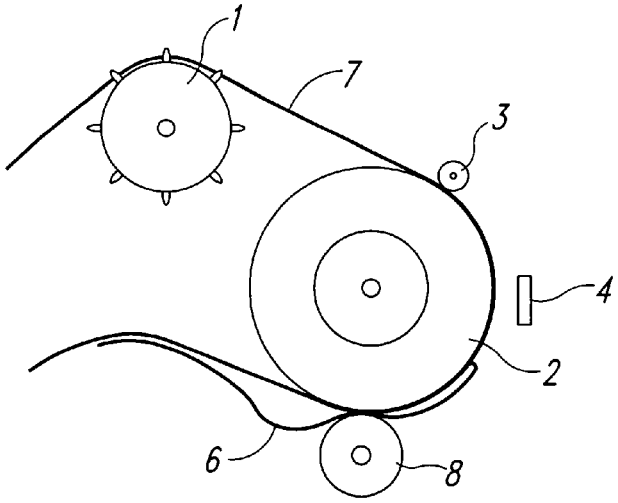
Fig. 1 (Prior Art)
FIG. 1 is a schematic side elevational drawing of a tractor-feed mechanism, which is known in the art.
Figure 2:
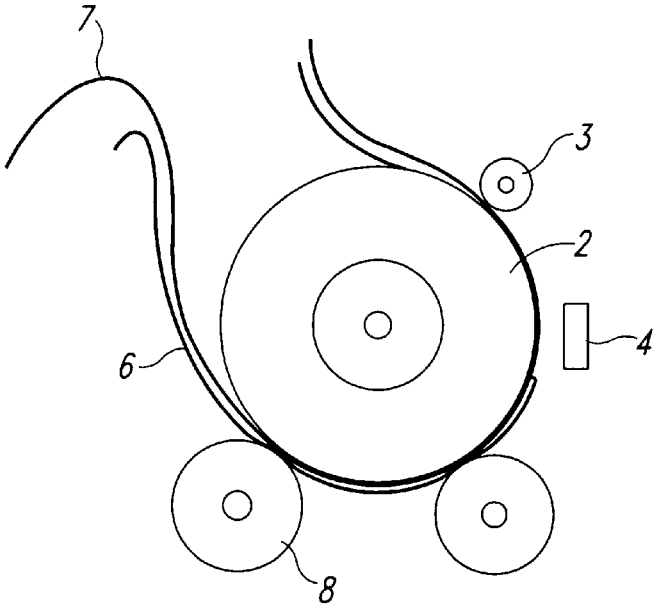
Fig. 2 (Prior Art)
FIG. 2 is a schematic side elevational drawing of a friction-feed mechanism, which is known in the art.
Figure 3:
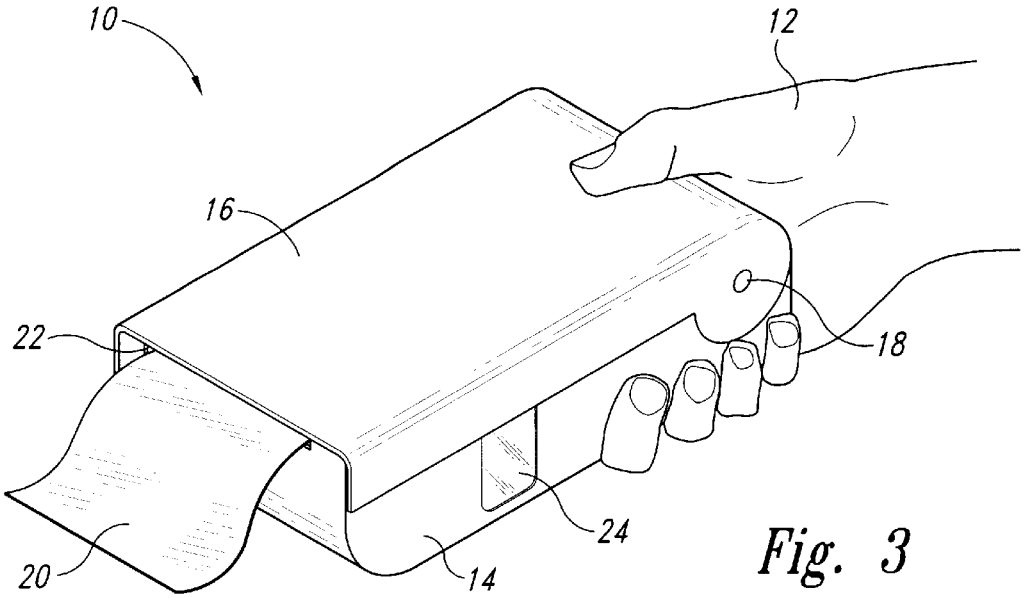
FIG. 3 is an isometric view of a first exemplary embodiment of the inventive printer showing the user holding the printer and a portion of the print media extending from the printer.

An exemplary embodiment of a printer 10 held by a user 12 is shown in FIG. 3. The printer 10 includes a base 14 and a cover 16 which is pivotally mounted to the base 14 by pivot pin 18 for movement between an open and a closed position. As shown in FIG. 3, the cover 16 is in the closed position with respect to the base 14. One skilled in the art will realize that the terms cover and base are chosen for convenience and do not necessarily imply any particular orientation to the printer 10 and the elements comprising the printer 10. The printer 10 prints on media, such as print media 20 which exits the printer 10 through an exit 22 formed in the base 14. An opening or window 24 is defined in the base 14 and positioned such that a supply of the print media 20 received in the printer 10 may be observed. In this fashion, the user 12 may determine the amount of print media 20 remaining.

Figure 4:
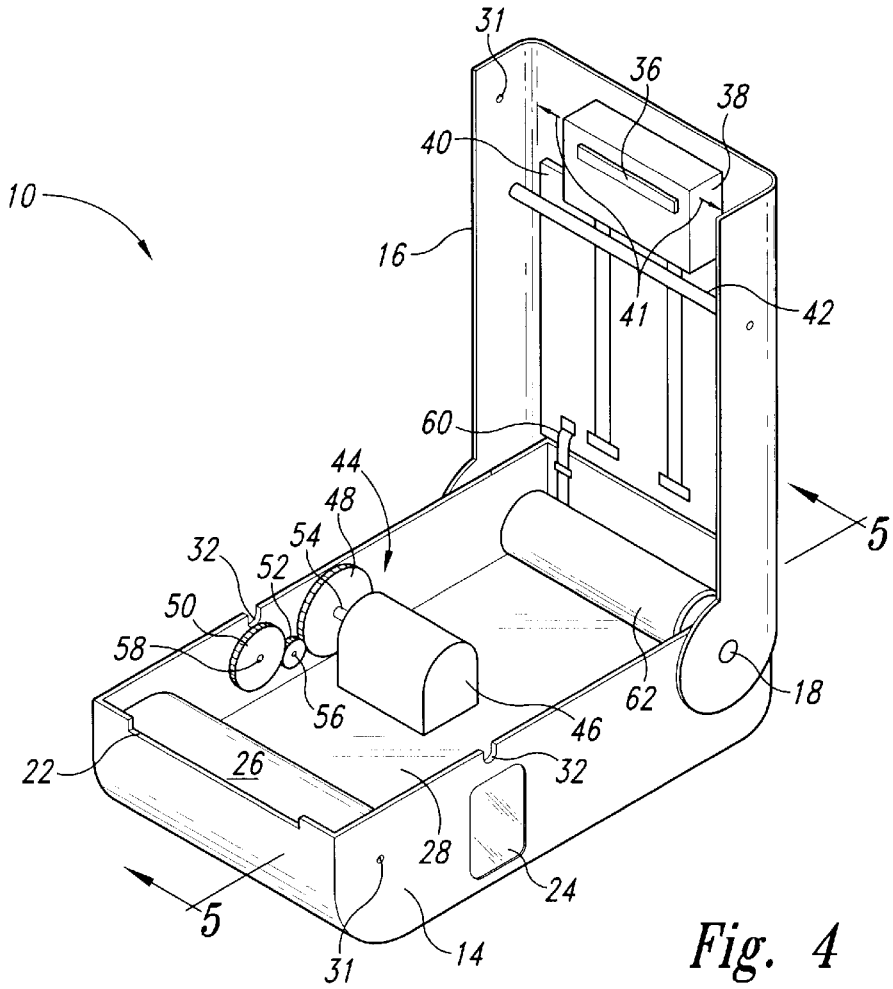
FIG. 4 is an enlarged isometric view of the printer of FIG. 3 with a cover open to expose internal components of the printer.
Figure 5:
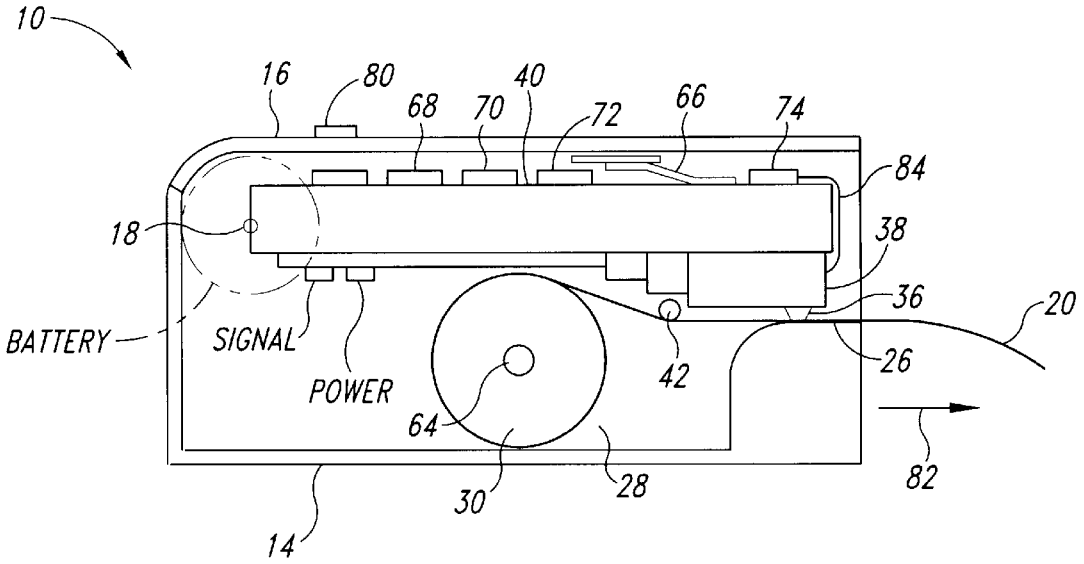
FIG. 5 is a schematic side cross-sectional drawing of a portion of the printer of FIG. 3, taken along the line 5—5 of FIG. 4, and showing the print head resiliently engaging a print media.

FIG. 4 shows the printer 10 of FIG. 3 with the cover 16 in the open position relative to the base 14. A platen 26 is formed in the base 14 as a substantially flat fixed surface proximate the exit 22. A media receptacle 28 in the base 14 receives the media supply therein, such as a print media roll 30 (FIG. 5). The print media may take other forms, such as a stack of individual sheets received in the media receptacle 28 or sheets individually fed into the printer 10 through an entrance (not shown) defined therein. A pair of bearing surfaces 32 are defined in the base 14 for rotatably supporting the print media roll 30. The cover 16 may be held in the closed position by way of a latch, such as detent mechanism 31.

The cover 16 carries a conventional thermal print head 38 that includes a linear array of print elements 36. The print head is mounted to a printed circuit board 40. The print head 38 may be fixedly mounted to the printed circuit board 40 or may be mounted for pivotally movement about a longitudinal axis 41. The print elements 36 are positioned to be in opposed relation to the flat portion of the platen 26 when the cover 16 is in the closed position. FIG. 4 shows the print head 36 spaced from the platen 26 while the cover 16 is in the open position. A bail roller 42 is shown rotatably mounted to the cover 16 for guiding the paper 20 (FIG. 5).

A drive mechanism 44 is shown mounted in the base 14. The drive mechanism 44 includes a stepper motor 46, a drive gear 48, secondary gear 50, and interim gear 52. The drive gear 48 is mounted to a drive shaft 54 which is driven by the drive motor 46. The teeth of the drive gear 48 mesh with the teeth of the interim gear 52 for transmitting torque thereto. The interim gear 52 is mounted to the base 14 by interim shaft 56. The teeth of the interim gear 52 mesh with the teeth of the secondary gear 50 for transmitting torque thereto. The secondary gear 50 is rotatably mounted to the base 14 by secondary shaft 58. The drive motor 46 is controlled by a microprocessor 68 (FIG. 5) mounted on the printed circuit board 40. Communication therebetween is provided by a bus or line 60. The line 60 may also provide power from the battery 62 to the microprocessor 68 and the drive motor 46. As can be seen in FIG. 4, unhindered access is provided to the print head 38 and the platen 26 when the cover 16 is in the open position.

FIG. 5 shows a cross-section of the exemplary embodiment of the printer taken along cross-section line 5—5 of FIG. 4 with the cover 16 in the closed position relative to the base 14. The print media roll 30 is shown mounted in the media receptacle 28 of the base 14. The print media roll 30 on which the print media 20 originally resides is carried by the base 14 and rotatably supported by a hollow cylindrical roll axle 64 to provide a continuous length of the print media 20. The print media 20 may be a linerless thermal medium having a series of labels linked end-to-end (or continuous stock, like tape, without liner). The print media 20 is wound around the roll axle 64 to form the print media roll 30. The roll axle 64 is rotatably carried by the bearing surfaces 32 (FIG. 4). The roll axle 64 preferably carries teeth sized to mesh with the teeth of secondary gear 50. Alternatively, the secondary gear 50 may transmit torque to the roll axle 64 by way of a belt, toothed belt or through frictional engagement. Thus, the drive mechanism may cause the print media 20 to advance along the media path. The bail roller 42 assists in positioning the print media 20 along the media path. The print media 20, extending from the print media roll 30 to the exit of the printer 22, defines the print media path through the printer 10. The print media path passes between platen 26 and print head 38. Linerless thermal print media is known in the art, a description of which may be found in U.S. Pat. No. 4,604,635 to Wiklof et al. It is also possible to use a liner type media with, for example, a liner separation blade or cutter (not shown) positioned at the exit 22 of the printer 10.

Alternatively, a thermally sensitive print ribbon with a ribbon take-up roll, as is conventional for thermal printers, may be used in conjunction with a conventional paper (or thermal paper) in place of the linerless thermal print media or linerless thermal transfer with ink ribbon. Moreover, while a print head 38 in the printer 10 is preferably a thermal print head, other printing heads, such as ink jet print heads may be used. In such embodiments, the print media 20 need not include a thermally sensitive layer or ribbon.

The array of print elements 36 of the print head 38 is located at a printing position when the cover 16 is in the closed position. In the case of a thermal print head, the printing position is located at a point at which the thermal print elements 36 are sufficiently close to the media 20 to cause the media 20 to thermally react. Thermal print heads often include a protective layer provided over the thermal print elements. The thickness of the protective layer is such that the thermal print elements are properly spaced with respect to the media when the protective layer is adjacent the media. In the case of an ink jet print head, the printing position is sufficiently spaced from the media 20 so as to form well defined dots thereon. Thus, the printing position is determined by the specific print head type, and is such that the print head is positioned at an effective distance for printing on the media 20.

To maintain proper pressure of the print head 38 on the print media 20, the printed circuit board 40 bearing the print head 38 is movably supported by the cover 16 and biased to move toward the print media 20 and platen 26 by a spring 66 that is positioned between the cover 16 and the printed circuit board 40. The spring 66 may be integrally formed with the cover 16. The spring 66 may be chosen and positioned to ensure that a constant and appropriate amount of pressure is maintained between the print head 38 and the media 20. The circuit board 40 carries the microprocessor 68, a memory 70, a buffer 72, and a print driver 74 for controlling the drive mechanism 44 and the print head 38.

Operation of the first exemplary embodiment of the printer 10 will now be discussed with reference to FIGS. 3, 4 and 5. The printer 10 is initially opened by moving the cover 16 into the open position with respect to the base 14, as shown in FIG. 4. Opening the printer 10 exposes the media path which permits simple drop loading of the media supply 30 into the media receptacle 28. In the example shown, the media supply 30 consists of a continuous roll of linerless thermal print media 20 which is carried on the roll axle 64. The roll axle 64 is rotatably supported by the support surfaces 32 defined in the base 14 of the printer 10. A set of teeth defined on the roll axle 64 mesh with the teeth of the secondary gear 50. The tail of the print media 20 is located on the platen 26 extending out of the exit 22. The user 12 may then pivot the cover 16 into the closed position with respect to the base 14, as shown in FIGS. 3 and 5. Closing the cover 16 causes the print element 36 of print head 38 to move into the printing position with respect to the platen 26 and the print media 20. The printing position is determined by the print head type. Thus, the printer 10 is loaded and ready for printing.

The user 12 may actuate a key or button 80 (FIG. 5) to begin printing. The button 80 is located on the exterior of the cover 16, although the button 80 may be positioned at any convenient location. Activating the button 80 sends a signal to the microprocessor 68 to begin printing. The microprocessor 68 causes the drive motor 46 to turn. The turning movement of the drive motor 46 is transferred to the media supply 30 through the gears 48, 50, 52 and the roll axle 64. The movement causes the media 20 to advance along the media path in the direction of arrow 82 (FIG. 5). The media 20 advances between the print head 38 and the platen 26. The microprocessor 70 controls and monitors the travel of the media 20 past the print head 38.

From the determination of the traveled distance of the media 20, the microprocessor 68 determines when successive portions of the media 20 are aligned with the print head 38 for printing. The microprocessor 68 then determines a desired image portion to be printed on each successive portion of the media 20 and identifies an appropriate energizing signal for the print head 38 to produce the desired image portion.

To identify the desired image portion to print, the microprocessor 68 retrieves image data stored in the memory 70 having several memory locations, each corresponding to a pixel of the image. Each memory location contains a data bit, byte or sequence of data bits corresponding to the memory locations' respective individual pixel, with each such data bit or sequence of data bits representing the printing or not printing of the pixel. For example, a logic level "1" may correspond to printing the particular pixel and a logic level "0" may correspond to not printing the particular pixel. The pixels of the image thus map in a one-to-one relationship to locations in the memory 70 containing data bits (i.e., a "bitmap").

The microprocessor 68 retrieves the data from the memory 70 on a line-by-line basis. That is, the microprocessor 68 retrieves and loads a data bit or sequence of data bits for each element in the array of print elements 36 of the print head 38 as a group into the buffer 72 for printing. The portion of the media 20 with which the print head 38 is aligned contains a plurality of regions, each aligned to one of the print elements 36. All of the print elements 36 may be activated simultaneously to print a narrow portion (i.e., a line) of the image, with each of the regions representing a single pixel of the image to be printed (or not printed) while the print head 38 is aligned to the portion of the media 20. The microprocessor 68 determines whether or not to print each pixel based upon the determination of the portion of the media 20 to which the print head 38 is aligned, and the position of each print element 36 in the print head 38.

To actually print the desired portion of the image, the data bits retrieved from the memory locations of the memory 70 corresponding to the particular pixels in the desired image portion are sent to the buffer 72 and clocked into the print driver 74 under control of the microprocessor 68. The print driver 74 then provides an energizing signal to all of the print elements 36 in the print head 38 through a print line 84. In the thermal print head of the preferred embodiment, the print driver 74 includes current drivers and complementary logic components in accordance with conventional design.

The print driver 74 is driven by the retrieved data in combination with a system clock signal under control of the microprocessor 68 to ensure proper timing and spacing of successive desired portions of the image to be printed. The microprocessor 68 controls the spacing of successive desired portions of the image by first monitoring the rotation of the stepper drive motor 46 to calculate the velocity of the media 20 past the print head 38. Based upon the calculation, the microprocessor 68 activates the print head 38 before the portion of the media 20 to be printed actually reaches the print head 38, so that the print elements 36 will have sufficient time to heat to a printing temperature before the portion of the media 20 passes the print head 38.

As each individual print element 36 is heated, the region of the media 20 aligned to a particular print element 36 is heated. The heat from the print element 36 activates the thermally sensitive media 20 and produces the desired portion of the printed image. Because the print head 38 is mounted to the printed circuit board 40 which is movably mounted to the cover 16, the print head 38 can move inward toward the platen 36 to maintain a firm but constant pressure between the print head, media 20 and platen 26.

Figure 6:
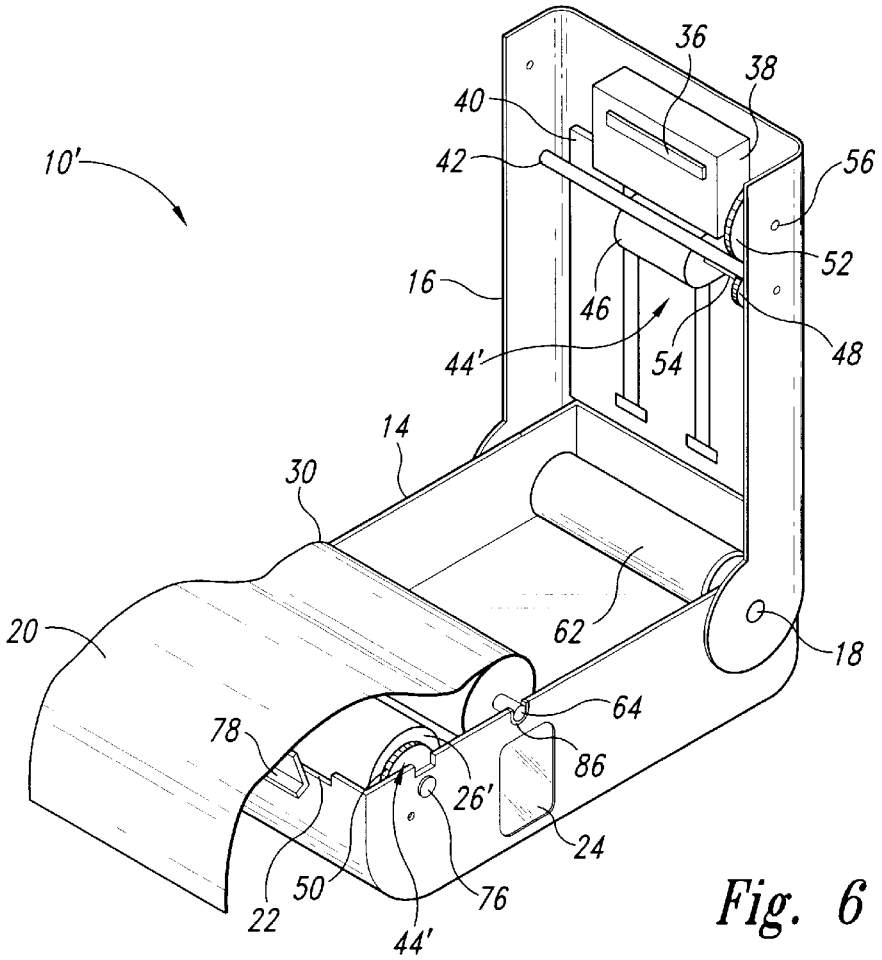
FIG. 6 is an enlarged isometric view of a second exemplary embodiment of the inventive printer with the cover open to expose internal components of the printer.

A second exemplary embodiment of the printer 10' is shown in FIG. 6. The second exemplary embodiment includes an approximately cylindrical platen 26' which is rotatably mounted by way of platen axle 76 to the base 14 of the printer 10. The roller 42 carried by the cover 16 is positioned for firmly holding the media 20 against the platen 26'. The secondary gear 50 is mounted on the platen axle 76. Thus, the printer 10' works in a similar fashion to conventional friction-fed mechanisms. Additionally, a bushing 86 is provided on the base 14 for rollably supporting the roll axle 64.

In the second exemplary embodiment, the drive mechanism 44' has been altered from that of the first embodiment by moving the drive motor 46, the primary gear 48 and the interim gear 52 to the cover 16 of the printer 10'. The drive motor 46 may be directly mounted to the printed circuit board 40 and appropriate electrical connections made therebetween. The interim gear 52 is mounted to the cover 16 by the interim shaft 56. The teeth of the interim gear 52 mesh with the teeth of the secondary gear 50 when the cover 16 is in the closed position. Additionally, a tear bar 78 is provided on the housing located proximate the exit 22. Operation of the alternative embodiment of the printer 10' is similar to operation of the embodiment shown in FIGS. 3, 4 and 5.

Figure 7:
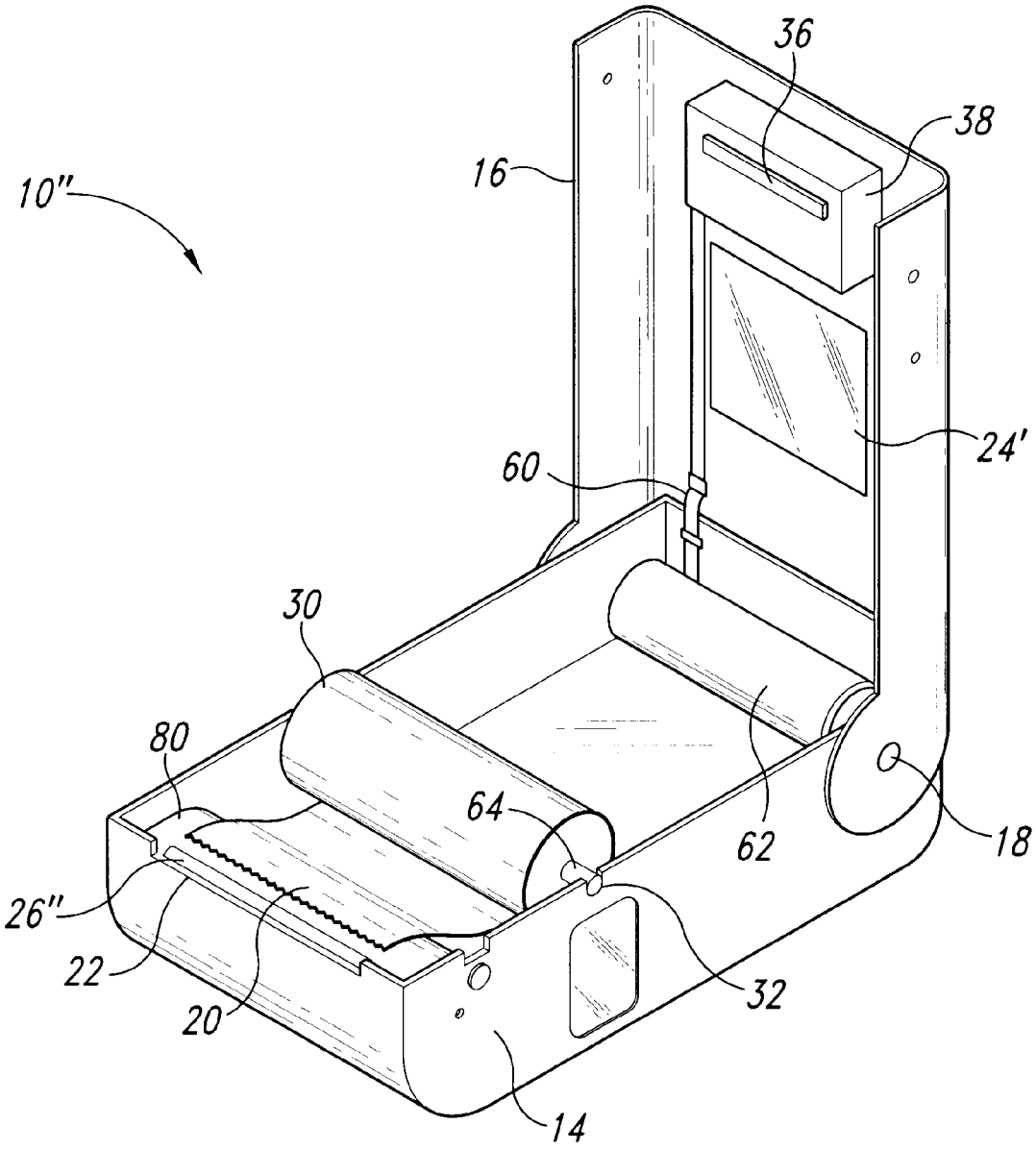
FIG. 7 is an enlarged isometric view of a third exemplary embodiment of the inventive printer with the cover in the open position.

A third exemplary embodiment of the printer 10" is shown in FIG. 7. The third embodiment includes a platen roller 26" which is rotatably mounted to the base 14 of the printer 10". The platen roller 26" is driven by a drive mechanism (not shown) which is located in the base 14. A surface in the interior of the base 14 forms a paper guide 80 for guiding the paper 20 from the roll 30 toward the exit 22. The paper 20 is firmly pressed between the print head 38 and the platen roller 26", thereby eliminating the need for a bail roller. A window 24' is formed in the cover 16 of the printer 10" for viewing the paper supply 30.

Although specific embodiments of, and examples for, the present invention are described herein for illustrative purposes, various equivalent modifications can be made without departing from the spirit and scope of the invention, as will be recognized by those skilled in the relevant art. For example, the teachings provided herein of the present invention can be applied to desktop printers, not necessarily the exemplary hand-held printer generally described above.

The drive mechanism may be removed, and the user may advance the media through the printer by hand. Such an example is shown in applicants' commonly assigned U.S. patent application Ser. No. 08/454,503. The removal of the drive mechanism would provide significantly longer battery life. Additionally, a device for monitoring the movement of the media through the printer may be provided, such as the devices described in U.S. patent application Ser. No. 08/454,503. Each United States patent and patent application cited herein is incorporated herein by reference. The printer may also be provided with additional user input devices for adjusting printing parameters, or selecting desired images. Also, the print head may be mounted directly to a slot on the circuit board, thus avoiding the need for a print head cable. The microprocessor may be programmed to function in a variety of ways based on the button input. For example, a single depression of the button may cause the printer to print one or any number of labels. The printer may continuously print labels as long as the button is depressed. Alternatively, the printer may print only when the button has been pressed and released. These and other changes can be made to the invention in light of the above detailed description. In general, in the following claims, the terms should not be construed to limit the invention to the specific embodiments disclosed in the specification and the claims, but should be construed to include all printers that operate in accordance with the claims. Accordingly, the invention is not limited by the disclosure but instead its scope is to be determined entirely by the following claims.

We claim:

1. A printer for printing an image on a media, the printer comprising:

a housing, the housing having a base and a cover, the cover pivotally mounted to the base for movement between a closed position and an open position spaced from the closed position;

a platen received in the housing and coupled thereto;

a print head received in the housing and coupled thereto such that when the cover is in the closed position the print head is positioned in a printing position opposed to and proximate the platen and when the cover is in the open position the print head is spaced from the printing position;

a spring integrally formed with the housing and positioned therein to bias the print head toward the printing position; and a media path defined in the housing, the media path passing between the print head and the platen.

2. The printer of claim 1, wherein the print head is coupled to the cover and the platen is coupled to the base.

3. The printer of claim 1, further comprising:

a microprocessor mounted to a printed circuit board which is received in the housing and mounted thereto, and wherein the print head is coupled to the printed circuit board such that the microprocessor is in controlling communication with the print head.

4. The printer of claim 1, further comprising:

a microprocessor mounted to a printed circuit board which is received in the housing and coupled to the cover, and wherein the print head is coupled to the printed circuit board such that the microprocessor is in controlling communication with the print head.

5. The printer of claim 1 wherein the printing position is adjacent the platen.

6. The printer of claim 1, further comprising:

a power source received within the housing and electrically coupled to the print head.

7. A printer for printing an image on a media, the printer comprising:

a housing, the housing having a base and a cover, the cover pivotally mounted to the base for movement between a closed position and an open position spaced from the closed position;

a platen integrally formed with the housing;

a print head received in the housing and coupled thereto such that when the cover is in the closed position the print head is positioned in a printing position opposed to and proximate the platen and when the cover is in the open position the print head is spaced from the printing position; and a media path defined in the housing, the media path passing between the print head and the platen.

8. The printer of claim 7, further comprising:

a stepper motor received in the housing and adapted to advance the media with respect to the print head.

9. The printer of claim 7, further comprising:

a stepper motor received in the housing and adapted to advance the media with respect to the print head, wherein the stepper motor and the print head are both coupled to the cover.

10. The printer of claim 7, further comprising:

a window formed in the housing, the window positioned to provide a view of the media.

11. The printer of claim 7, further comprising:

a media receptacle formed in the housing for receiving a supply of the media in the form of a roll therein.

12. The printer of claim 7, further comprising:

a media receptacle formed in the housing for receiving a supply of the media in the form of a stack of individual sheets therein.

13. The printer of claim 7, further comprising:

an entrance formed in the housing at a first end of the media path for receiving the media; and an exit formed in the housing at a second end of the media path for delivering the media after the media has been printed on.

14. A printer for printing on a media, the printer comprising:

a housing including a first housing portion and a second housing portion pivotally coupled to the first housing portion for movement between a closed position and an open position;

a platen received in the housing and coupled thereto;

a print head received in the housing and coupled thereto for movement therewith between a printing position proximate the platen when the second housing portion is in the closed position and a position spaced from the platen when the second housing portion is in the open position; and a spring integrally formed with the housing and positioned to bias the print head toward the printing position.

15. The printer of claim 14 wherein:

the platen is coupled to the second housing portion; and the print head is coupled to the first housing portion, opposed to the platen.

16. The printer of claim 14, further comprising:

a microprocessor received in the housing, the microprocessor in controlling communication with the print head.

17. The printer of claim 14, further comprising:

a microprocessor coupled to a printed circuit board which is received in the housing and coupled to the first housing portion, and wherein the print head is coupled to the printed circuit board such that the microprocessor is in controlling communication with the print head.

18. The printer of claim 14, further comprising:

a printed circuit board, wherein the spring is positioned in the housing between the print head and the printed circuit board.

19. The printer of claim 14, further comprising:

a circuit board and wherein the spring is positioned between the first housing portion and the circuit board to which the print head is mounted.

20. The printer of claim 14 wherein the printing position is in thermal contact with the media.

21. The printer of claim 14 wherein the printing position is adjacent the platen.

22. The printer of claim 14, further comprising:

a power source received within the housing and electrically coupled to the print head.

23. The printer of claim 14, further comprising:

a battery received within the housing and electrically coupled to the print head.

24. The printer of claim 14, further comprising:

a stepper motor received in the housing and adapted to advance the print medium with respect to the print head.

25. The printer of claim 14, further comprising:

a stepper motor received in the housing and coupled to the platen for rotatably driving the platen.

26. The printer of claim 14, further comprising:

a stepper motor received in the housing and adapted to advance the print medium with respect to the print head, wherein the stepper motor and the print head are both coupled to the first housing portion.

27. The printer of claim 14, further comprising:

a window formed in the housing, the window positioned to provide a view of the media.

28. The printer of claim 14 wherein the housing defines a media receptacle therein for removably receiving the media.

29. The printer of claim 14 wherein the media has a central axis, and further comprising:

a core located at the central axis, and supported by at least one pair of bearing surfaces integrally defined in the housing, and wherein the media is wound around the core.

30. The printer of claim 14, further comprising:

a tear bar mounted to the housing proximate an exit formed in the housing.

31. A printer for printing on a media, the printer comprising:

a housing including an upper shell carrying a print head and a lower shell carrying a platen, the upper shell pivotally coupled to the lower shell for defining a media path therebetween when the upper shell is in a closed position with respect to the lower shell, and for providing access to the print head and the platen when the upper shell is in the open position with respect to the lower shell, the media path passing between the print head and the platen; and a spring integrally formed with the housing and positioned in the housing to bias the print head relatively toward the platen.

32. The printer of claim 31, further comprising:

a microprocessor mounted to a printed circuit board which is received in the housing and coupled to the upper shell for movement therewith, and wherein the print head is coupled to the printed circuit board such that the microprocessor is in controlling communication with the print head.

33. The printer of claim 31 wherein a distance between the print head and the platen is equal to an effective printing distance when the upper shell is in the closed position.

34. The printer of claim 31 wherein the housing defines a media receptacle therein for removably receiving the media.

35. The printer of claim 31 wherein the housing defines a media receptacle therein for removably receiving the media in the form of a roll.

36. The printer of claim 31 wherein the housing defines a media receptacle therein for removably receiving the media in the form of a stack of sheets.

37. The printer of claim 31 wherein the media has a central axis, and further comprising:

a core located at the central axis of the media and supported by at least one pair of bearing surfaces integrally defined in the housing, and wherein the media is wound around the core.

38. The printer of claim 31, further comprising:

a tear bar mounted to the housing proximate an exit formed in the housing.

39. The printer of claim 31, further comprising:

a stepper motor received in the housing and adapted to advance the media with respect to the print head.

40. The printer of claim 31 wherein the platen is rotatably mounted to the housing and, further comprising:

a stepper motor received in the housing and coupled to the platen for rotatably driving the platen with respect to the housing.

* * * * *